US008056188B2

(12) United States Patent
Villeminey

(10) Patent No.: US 8,056,188 B2
(45) Date of Patent: Nov. 15, 2011

(54) DOOR ASSIST ASSEMBLY FOR BEING GRASPED BY A USER OF A VEHICLE

(75) Inventor: Jean-Paul Villeminey, Milford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 388 days.

(21) Appl. No.: 12/395,966

(22) Filed: Mar. 2, 2009

(65) Prior Publication Data

US 2010/0218345 A1 Sep. 2, 2010

(51) Int. Cl.
*B25G 1/00* (2006.01)

(52) U.S. Cl. ..... 16/426; 16/412; 16/429; 296/146.7

(58) Field of Classification Search ..... 16/412, 16/405, 408, 426, 427, 429, 445; 292/336.3; 296/146.1, 146.7; 49/460, 504; 74/544
See application file for complete search history.

(56) References Cited

U.S. PATENT DOCUMENTS

| | | | | |
|---|---|---|---|---|
| 6,431,643 | B2 * | 8/2002 | Grey | 296/214 |
| 6,467,130 | B2 * | 10/2002 | Kurachi et al. | 16/438 |
| 6,616,222 | B1 * | 9/2003 | Ponceau | 296/214 |
| 6,793,869 | B2 * | 9/2004 | Davis et al. | 264/513 |
| 7,191,493 | B2 * | 3/2007 | Vanderpool et al. | 16/412 |
| 7,380,864 | B2 * | 6/2008 | Guanzon et al. | 296/146.1 |
| 7,407,209 | B2 * | 8/2008 | Stolarczyk et al. | 296/1.02 |
| 7,594,684 | B2 * | 9/2009 | Hidaka et al. | 296/1.02 |
| 7,617,571 | B2 * | 11/2009 | Lee et al. | 16/412 |
| 7,744,141 | B2 * | 6/2010 | Saionji et al. | 296/1.02 |
| 7,905,059 | B2 * | 3/2011 | Senoo | 49/503 |
| 2009/0144940 | A1 * | 6/2009 | Yamada et al. | 16/412 |

FOREIGN PATENT DOCUMENTS

| | | | |
|---|---|---|---|
| DE | 19727536 | A1 | 1/1999 |
| DE | 10144492 | A1 | 3/2003 |
| DE | 10200406114 | A1 | 7/2006 |
| EP | 0913284 | A2 | 5/1999 |
| JP | 2002309807 | A * | 10/2002 |

* cited by examiner

*Primary Examiner* — William L. Miller
(74) *Attorney, Agent, or Firm* — Quinn Law Group, PLLC

(57) ABSTRACT

A door assembly for a vehicle includes a door panel, a primary assist handle, a secondary assist handle, and a first and second extension. The primary assist handle and the secondary assist handles are configured for being grasped by the user of the vehicle. A first extension extends from the door panel. A second extension extends from a second mounting portion of the secondary assist handle, in spaced relationship to the first extension. The extensions pivotally support ends of the primary assist handle. The primary assist handle pivots relative to each of the extensions and the door of the vehicle, between a retracted position and an extended position. A first mounting portion of the secondary assist handle pivotally extends from the door panel.

19 Claims, 10 Drawing Sheets

DOOR ASSIST ASSEMBLY FOR BEING GRASPED BY A USER OF A VEHICLE

TECHNICAL FIELD

The present invention relates to a door assist assembly for being grasped by a user of a vehicle to facilitate opening or closing the door of the vehicle and/or to facilitate entry and exit of the user from the vehicle.

BACKGROUND OF THE INVENTION

Some vehicles have doors that, when in an open position, are open so far away from a seat within the vehicle that a user may have a difficult time reaching and grasping an interior door handle to pull the door closed when seated in the seat. The seats within these vehicles may also be so far off of the ground that some users have a difficult time gaining leverage to climb into or out of the seats of the vehicle.

SUMMARY OF THE INVENTION

A door assist assembly is configured to be grasped by a user of the vehicle. The door assist assembly includes an inner door panel, a primary assist handle, a first extension, and a second extension. The primary assist handle has a first end and a second end and is configured for being grasped by the user of the vehicle. The first extension extends from the door panel. The second extension extends from the door panel in spaced relationship to the first extension. The first extension pivotally supports the first end of the primary assist handle at a first pivot and the second extension pivotally supports the second end of the primary assist handle at a second pivot. The primary assist handle pivots about the first pivot and the second pivot, relative to each of the extensions and the door of the vehicle, between a retracted position and an extended position.

In an alternative embodiment, the door assist assembly includes a primary assist handle, a secondary assist handle, a first extension, and a second extension. The primary assist handle has a first end and a second end and is configured for being grasped by the user of the vehicle. The secondary assist handle has a first mounting portion and a second mounting portion and is configured for being grasped by the user of the vehicle. The first extension is configured to extend from a door panel. The second extension extends from the second mounting portion of the secondary assist handle, in spaced relationship to the first extension. The primary assist handle is disposed in generally perpendicular relationship to the secondary assist handle. The first extension pivotally supports the first end of the primary assist handle at a first pivot. The second extension pivotally supports the second end of the primary assist handle at a second pivot. The primary assist handle pivots about the first pivot and the second pivot, relative to each of the extensions and the door of the vehicle, between a retracted position and an extended position. The first mounting portion is configured to pivotally extend from the door panel at a third pivot.

According to another aspect of the invention, a door assembly for a vehicle includes an inner door panel, a primary assist handle, a secondary assist handle, a first extension, and a second extension. The primary assist handle has a first end and a second end and is configured for being grasped by the user of the vehicle. The secondary assist handle has a first mounting portion and a second mounting portion and is configured for being grasped by the user of the vehicle. The first extension extends from the door panel. The second extension extends from the second mounting portion of the secondary assist handle, in spaced relationship to the first extension. The primary assist handle is disposed in generally perpendicular relationship to the secondary assist handle. The first extension pivotally supports the first end of the primary assist handle at a first pivot and the second extension pivotally supports the second end of the primary assist handle at a second pivot. The primary assist handle pivots about the first pivot and the second pivot, relative to each of the extensions and the door of the vehicle, between a retracted position and an extended position. The first mounting portion of the secondary assist handle pivotally extends from the door panel at a third pivot.

Accordingly, by providing a door assist assembly, a user of the vehicle is provided with a primary assist handle to grasp that is close to the user when the user is seated. This allows the user to pull the interior door handle closer such that the user can then grasp the interior door handle and close the door. Additionally, the secondary door assist assembly provides the users with a surface on the door to grasp and support part of their weight while entering and exiting the vehicle.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Referring now to the figures, which are exemplary embodiments and wherein like elements are numbered alike.

DESCRIPTION OF THE PREFERRED EMBODIMENTS

Figure 1:
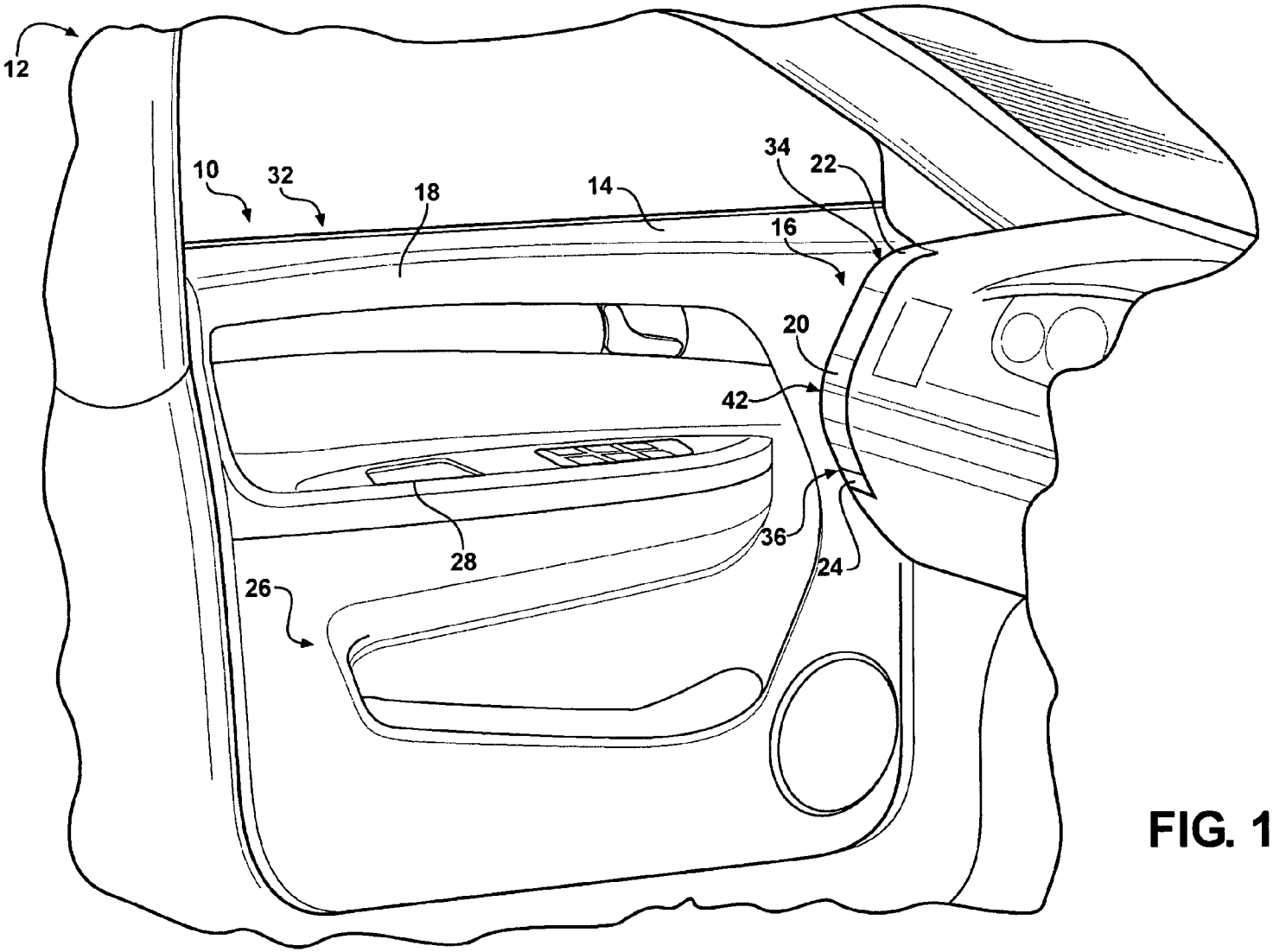
FIG. 1 is a partial schematic perspective view of an interior of a door and an instrument panel (IP) of a vehicle with a primary assist handle pivotally attached to the door and the door in a closed position.
Figure 2:
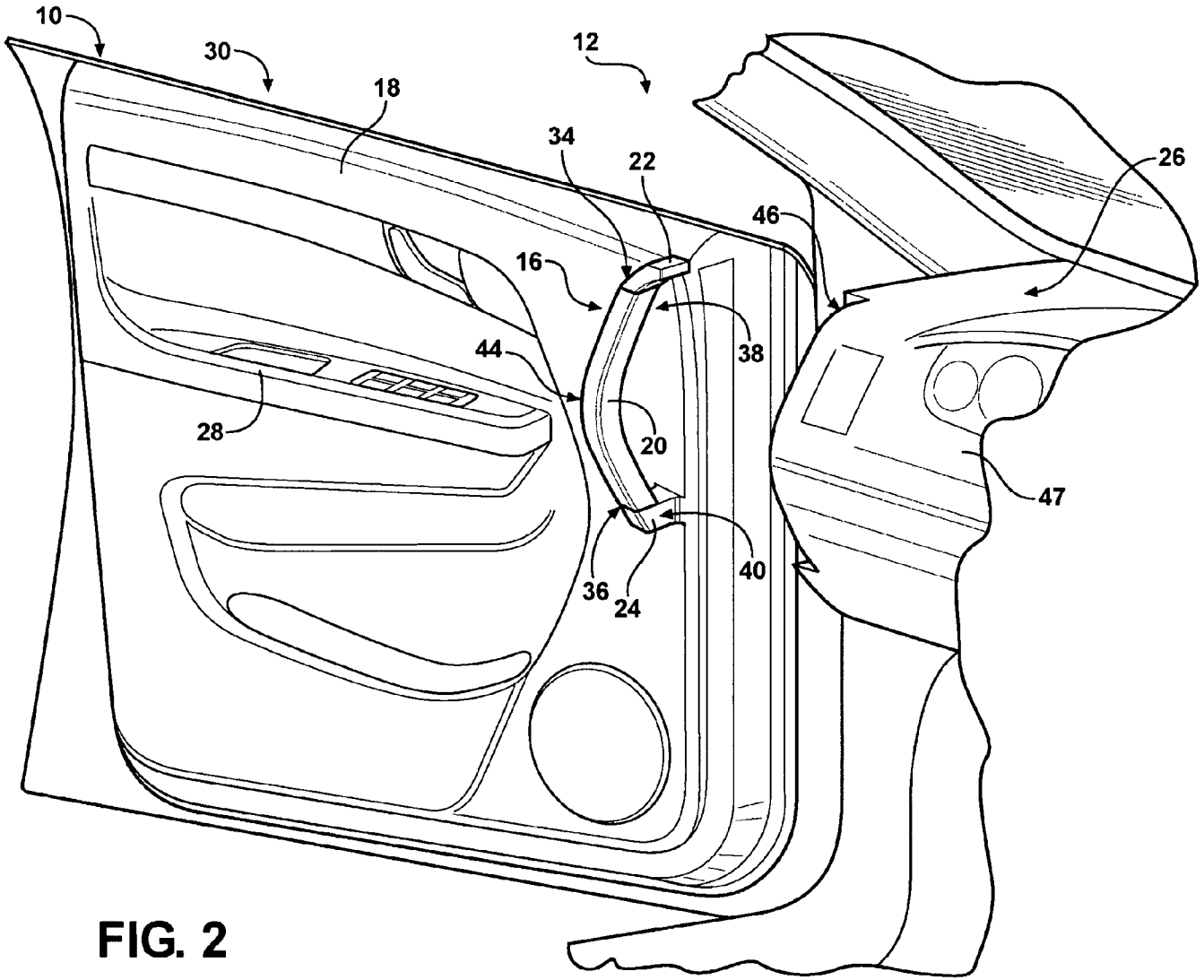
FIG. 2 is a partial schematic perspective view of the interior of the door and the IP of the vehicle with the primary assist handle pivotally attached to the door and the door in an open position.

Referring to the drawings, wherein like reference numbers refer to like components, FIG. 1 shows a door assembly 10 of a vehicle 12. The door assembly 10 includes a door 14 and an assist assembly 16 that is configured for being grasped by a user of the vehicle 12. The assist assembly 16 includes an inner door panel 18, a primary assist handle 20, a first extension 22, and a second extension 24. The door panel 18 is configured to extend from an interior 26 of the door 14 of the vehicle 12. The inner door panel 18 may be a trim panel, such as an interior door trim panel. However, it should be appreciated that the inner door panel 18 is not limited to being a trim panel, but may be any interior 26 portion of the door 14 known to those skilled in the art, such as sheet metal and the like. The inner door panel 18 may also include a pull handle 28 that the user grasps to pull the door assembly 10 from an open position 30 to a closed position 32. However, when the door assembly 10 is in the open position 30, the pull handle 28 may be too far away from the user to initially reach and grasp. Therefore, the primary assist handle 20 is disposed closer to the user on the inner door panel 18 than the pull handle 28. This allows the user to grasp and pull the primary assist handle 20 to pull the door assembly 10, and the pull handle 28, to within reach of the user. Once the pull handle 28 is within reach of the user, the user may grasp the pull handle 28 and pull the door assembly 10 into the closed position 32.

Figure 3:
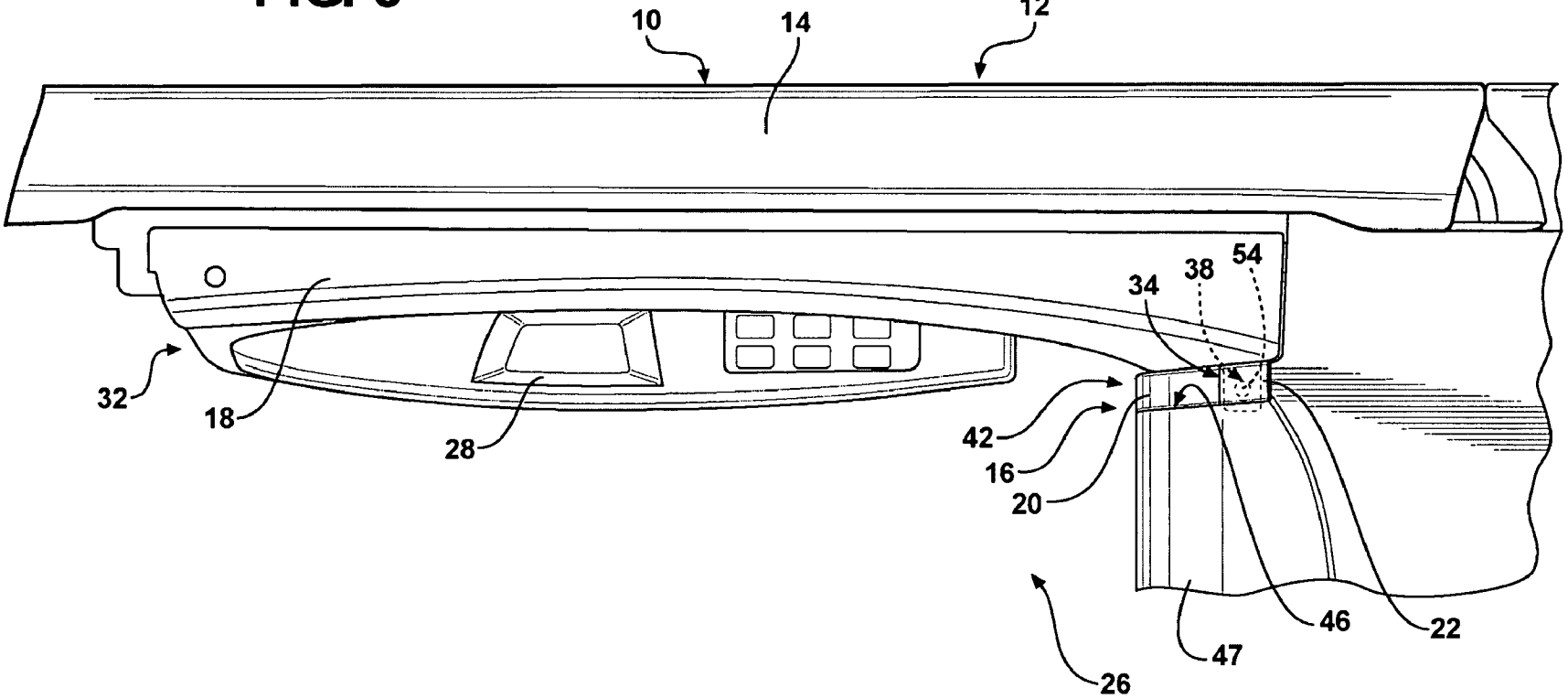
FIG. 3 is a partial schematic top view of the interior of the door of FIG. 1 with the door in the closed position and the primary assist handle disposed between the door and the IP.
Figure 4:
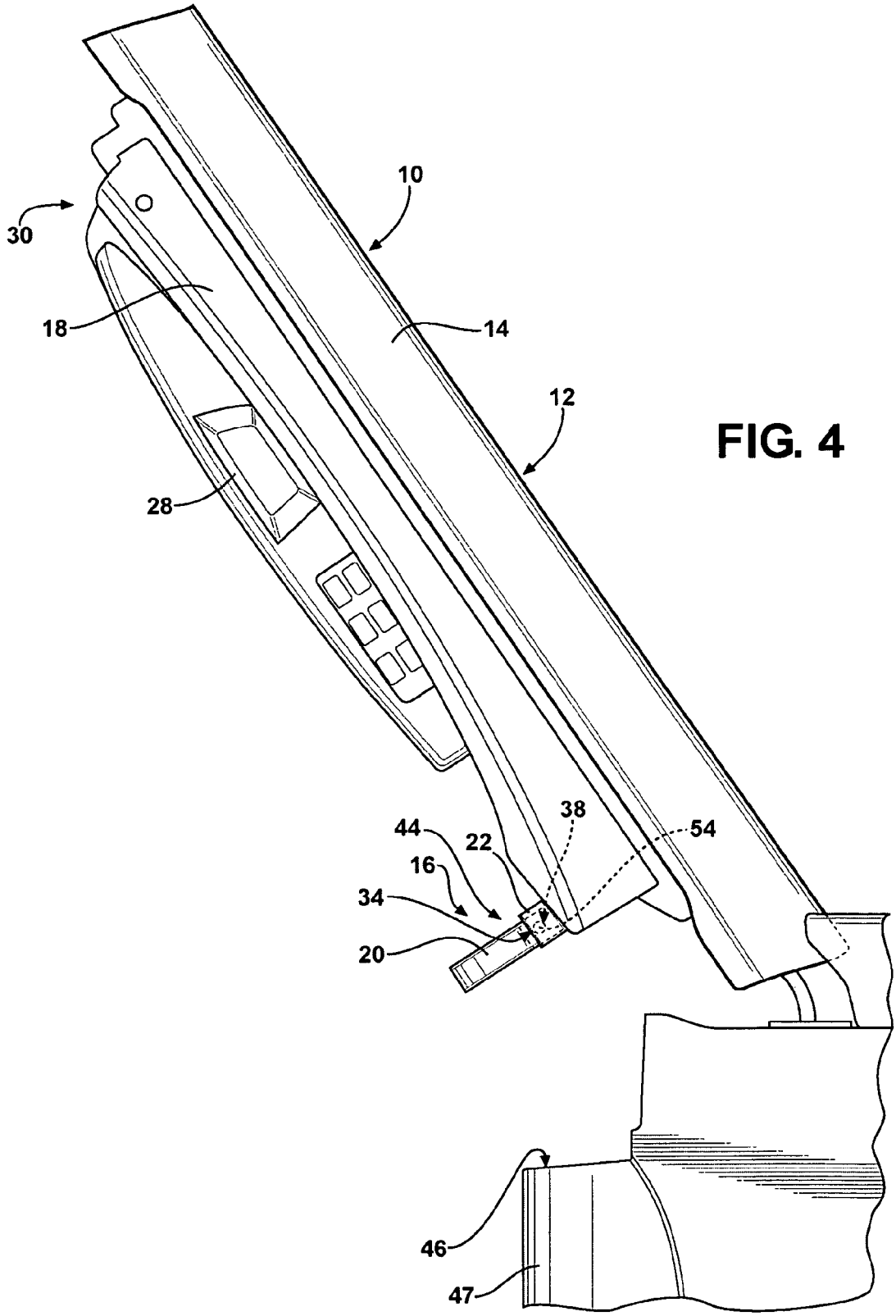
FIG. 4 is a partial schematic top view of the interior of the door and the IP of FIG. 1 with the primary assist handle pivotally attached to the door and the door in the open position with the primary assist handle pivotally extended.

The primary assist handle 20 extends between a first end 34 and a second end 36 and is configured for being grasped by a user of the vehicle 12. The first and second extensions 22, 24 each extend from the inner door panel 18 in spaced relationship. The door panel 18 and at least one of the first and second extensions 22, 24 may be a single piece. The first extension 22 pivotally supports the first end 34 of the primary assist handle 20 at a first pivot 38 and the second extension 24 pivotally supports the second end 36 of the primary assist handle 20 at a second pivot 40. The primary assist handle 20 is configured to pivot about the first pivot 38 and the second pivot 40, relative to each of the extensions, between a retracted position 42 and an extended position 44. The primary assist handle 20 is in the retracted position 42 when the door assembly 10 is in the closed position 32. Likewise, referring to FIGS. 2, 4, and 5, the primary assist handle 20 is in the extended position 44 when the door assembly 10 is in the open position 30. The primary assist handle 20 may extend in a generally vertical direction. As the door assembly 10 is moved or rotated to the closed position 32, an instrument panel 47 (IP) contacts the primary assist handle 20 when the primary assist handle 20 is in the extended position 44. Referring to FIGS. 1 and 3, contact with the IP 47 causes the primary assist handle 20 to rotate about the first and second pivots 38, 40 to the retracted position 42. Accordingly, referring again to FIGS. 2, 4, and 5, when the door assembly 10 is in the closed position 32 the IP 47 of the vehicle 12 abuts the primary assist handle 20. The IP 47 may define a recess 46, as shown in FIGS. 2-4 and 7-9 that is configured for receiving the primary assist handle 20 when the door assembly 10 is in the closed position 32. Additionally, referring to FIGS. 1, 3, 8, and 10, the primary assist handle 20 may be configured to be flush with the IP 47 when the door assembly 10 is in the closed position 32.

Referring to FIG. 1, the first pivot 38 may include a first biasing device 48 that reacts between the first end 34 of the primary assist handle 20 and the first extension 22. The second pivot 40 may also include a second biasing device 50 that reacts between the second end 36 of the primary assist handle 20 and the second extension 24. At least one of the biasing devices may be a spring 52, such as a torsion spring 52. However, it should be appreciated that other biasing devices known to those skilled in the art may also be used. The first and second biasing device 48, 50 are configured to rotate the primary assist handle 20 about the pivots from the retracted position 42 to the extended position 44 when the door assembly 10 is in the open position 30 such that the outer end 46 of the IP 47 no longer contacts the primary assist handle 20. As explained above, when the primary assist handle 20 is in the extended position 44, i.e., when the door assembly 10 is in the open position 30, the user of the vehicle 12 may grasp the primary assist handle 20 to pull the pull handle 28 of the door assembly 10 within reach of the user.

Figure 5:
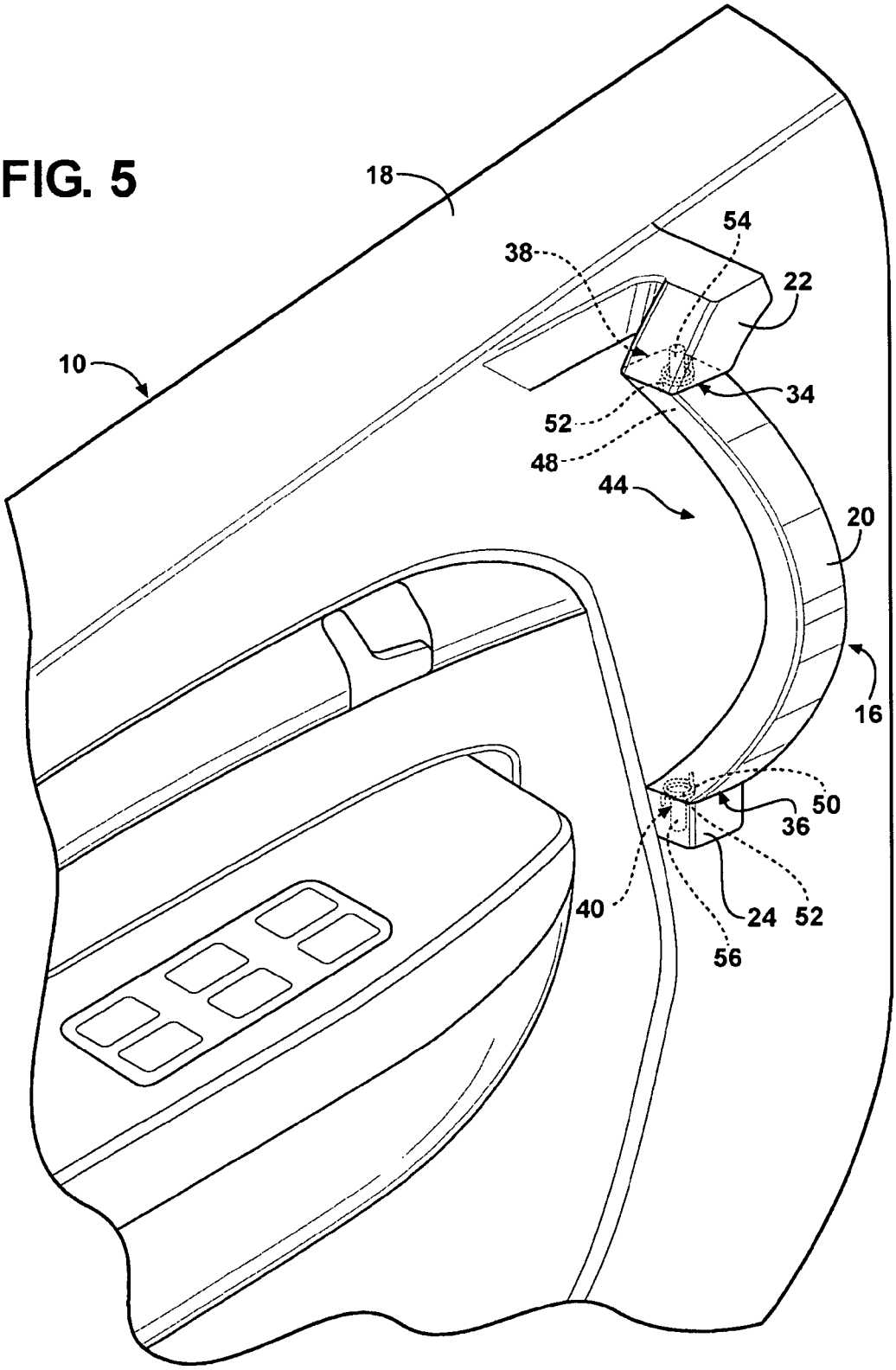
FIG. 5 is a partial schematic perspective view of the interior of the door of FIG. 1 with the primary assist handle pivotally attached to the door and the door in the open position with the primary assist handle pivotally extended.
Figure 6:
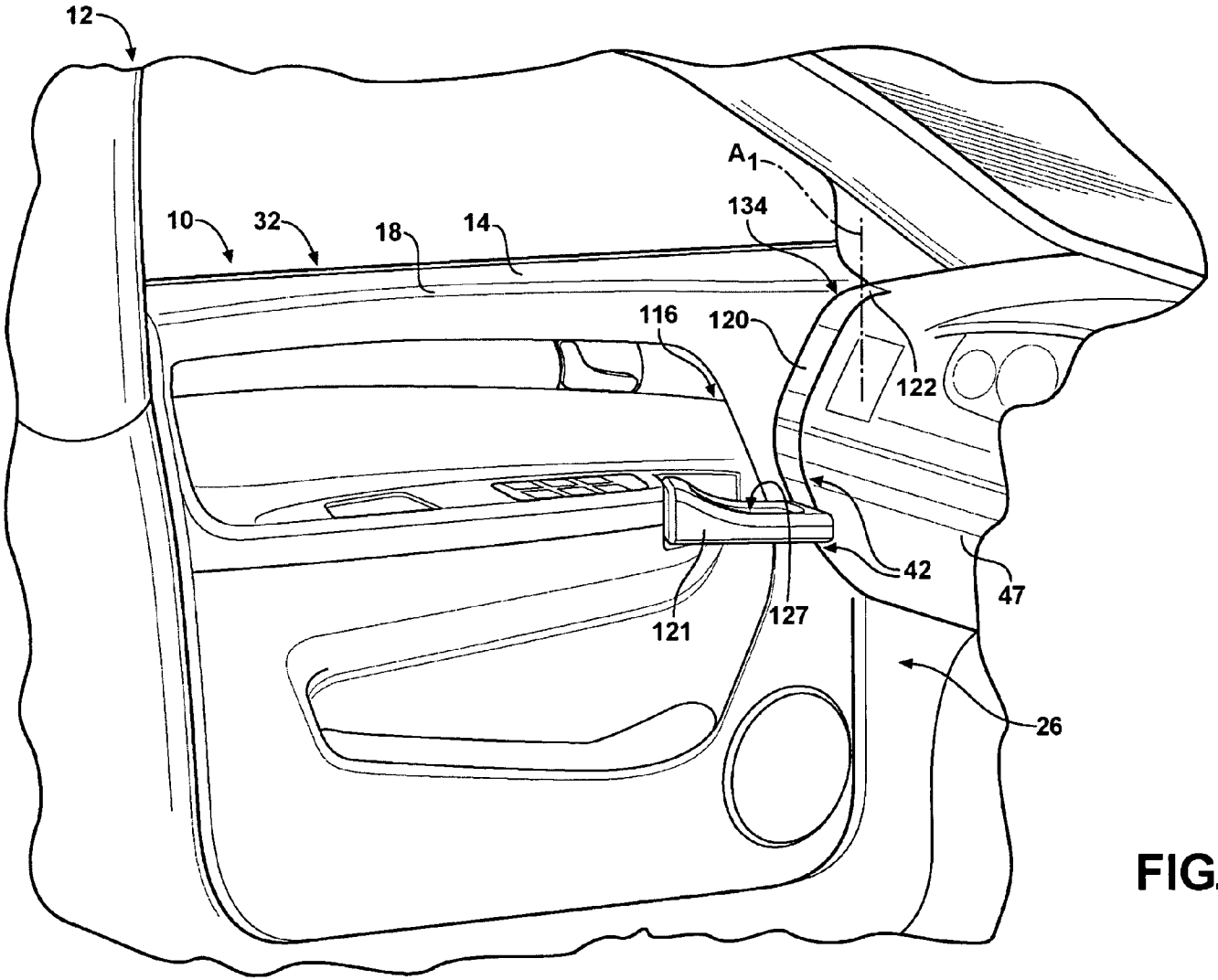
FIG. 6 is a partial schematic perspective view of an alternative embodiment of an interior of the door and the IP of the vehicle having the primary assist handle and a secondary assist handle attached to the door and the door in the closed position.

Referring to FIG. 5, the first pivot 38 may include a first pin 54 that rotatably interconnects the primary assist handle 20 and the first extension 22. Likewise, the second pivot 40 may include a second pin 56 that rotatably interconnects the primary assist handle 20 and the second extension 24. The pins 54, 56 may extend from the respective ends of the primary assist handle 20 and into engagement with the respective extension. Alternatively, the pins 54, 56 may extend from the respective extension and into engagement with the respective end of the primary assist handle 20. As yet another alternative, the pins 54, 56 may extend into engagement with both the respective ends of the primary assist handle 20 and the respective extensions. The pins 54, 56 may facilitate rotation of the primary assist handle 20 about the pivots, relative to the respective first and second extensions 22, 24.

In an alternative embodiment, shown in FIGS. 6-10, the door includes an assist assembly 116 having a primary assist handle 120 and a secondary assist handle 121. In this embodiment, the secondary assist handle 121 extends between a first mounting portion 123 and a second mounting portion 125 and is configured for being grasped by the user of the vehicle. The secondary assist handle 121 may define an opening 127 configured for receiving fingers of the user. The user may grasp the secondary assist handle 121 upon the entry and/or exit from the vehicle.

Figure 7:
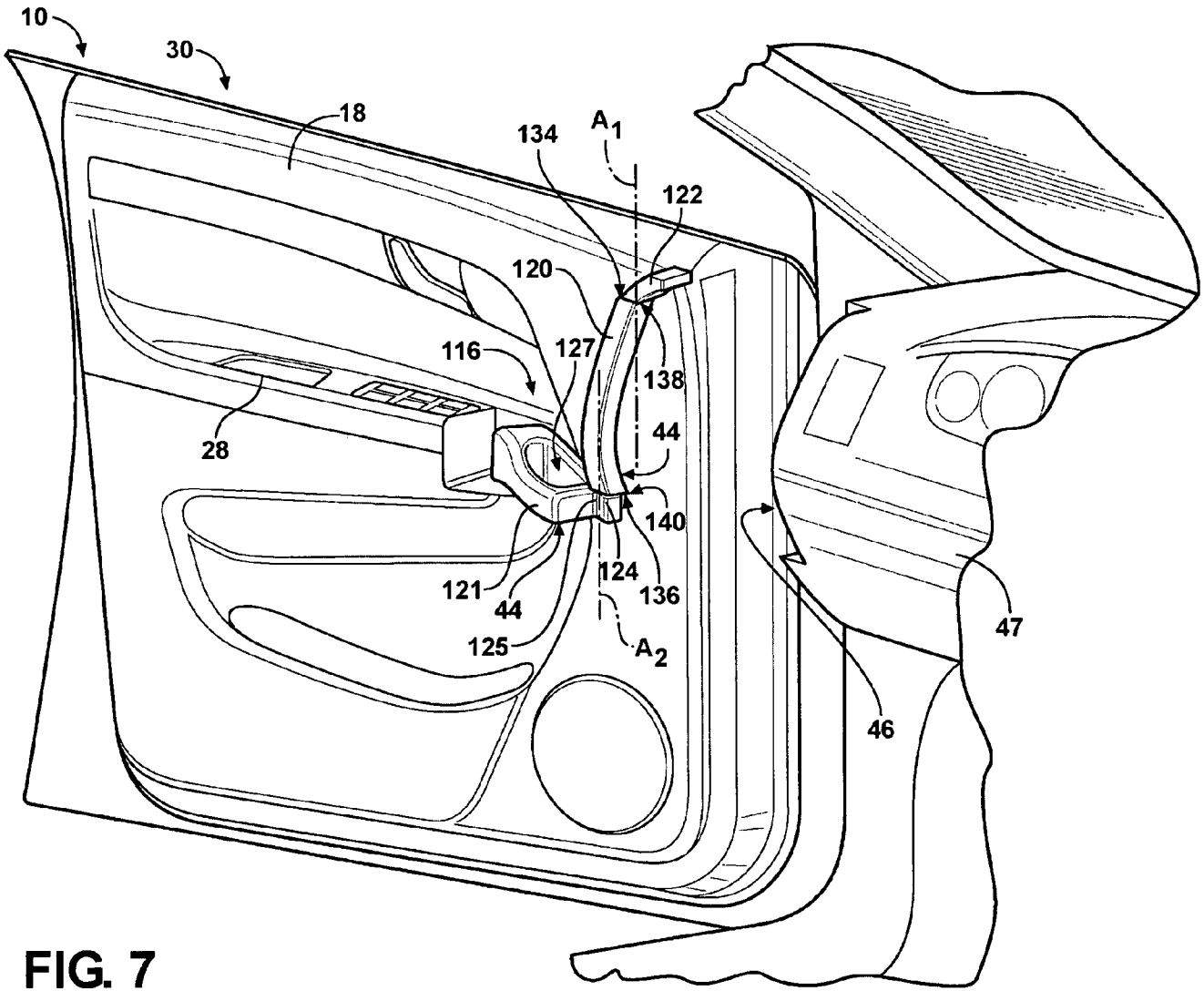
FIG. 7 is a partial schematic perspective view of the interior of the door of FIG. 6 with the door in the open position and the primary assist handle and the secondary assist handle pivotally extended.
Figure 8:
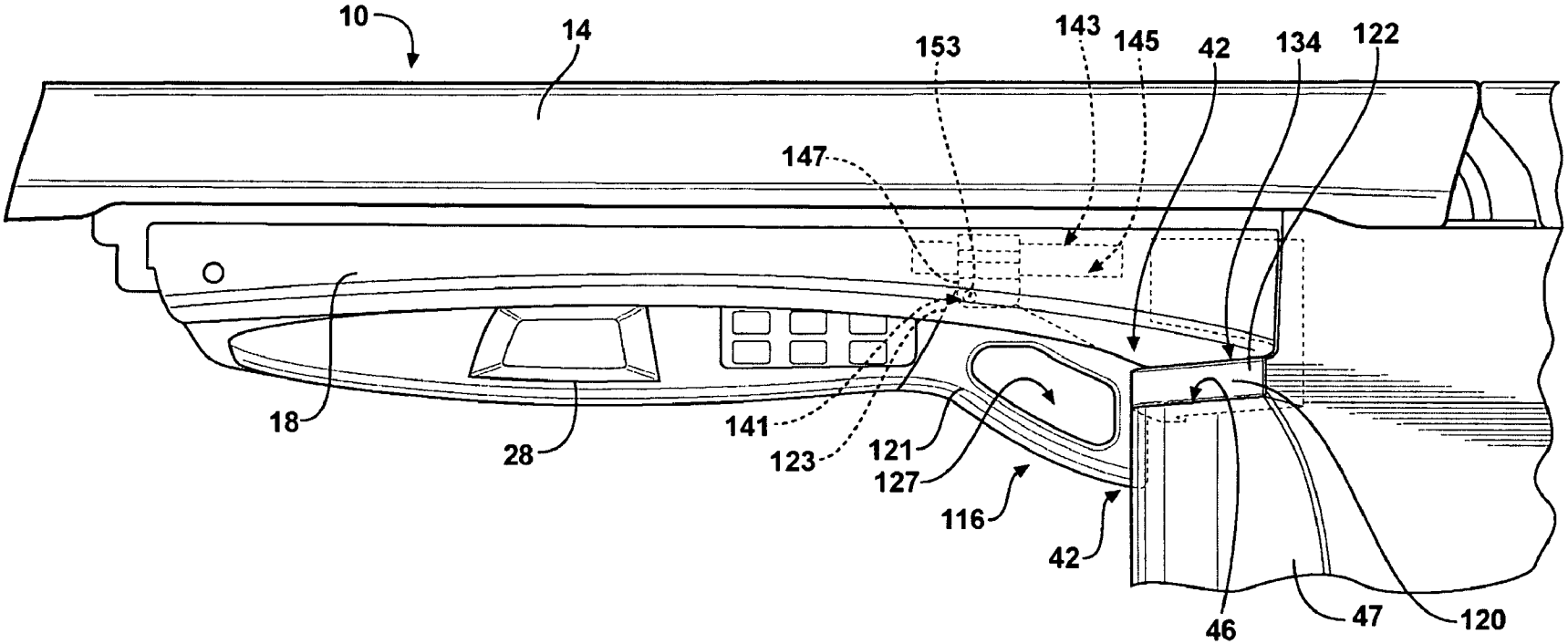
FIG. 8 is a partial schematic top view of the interior of the door and the IP of FIG. 6 with the door in the closed position and the primary assist handle disposed between the door and the IP and the secondary assist handle in a closed position.
Figure 9:
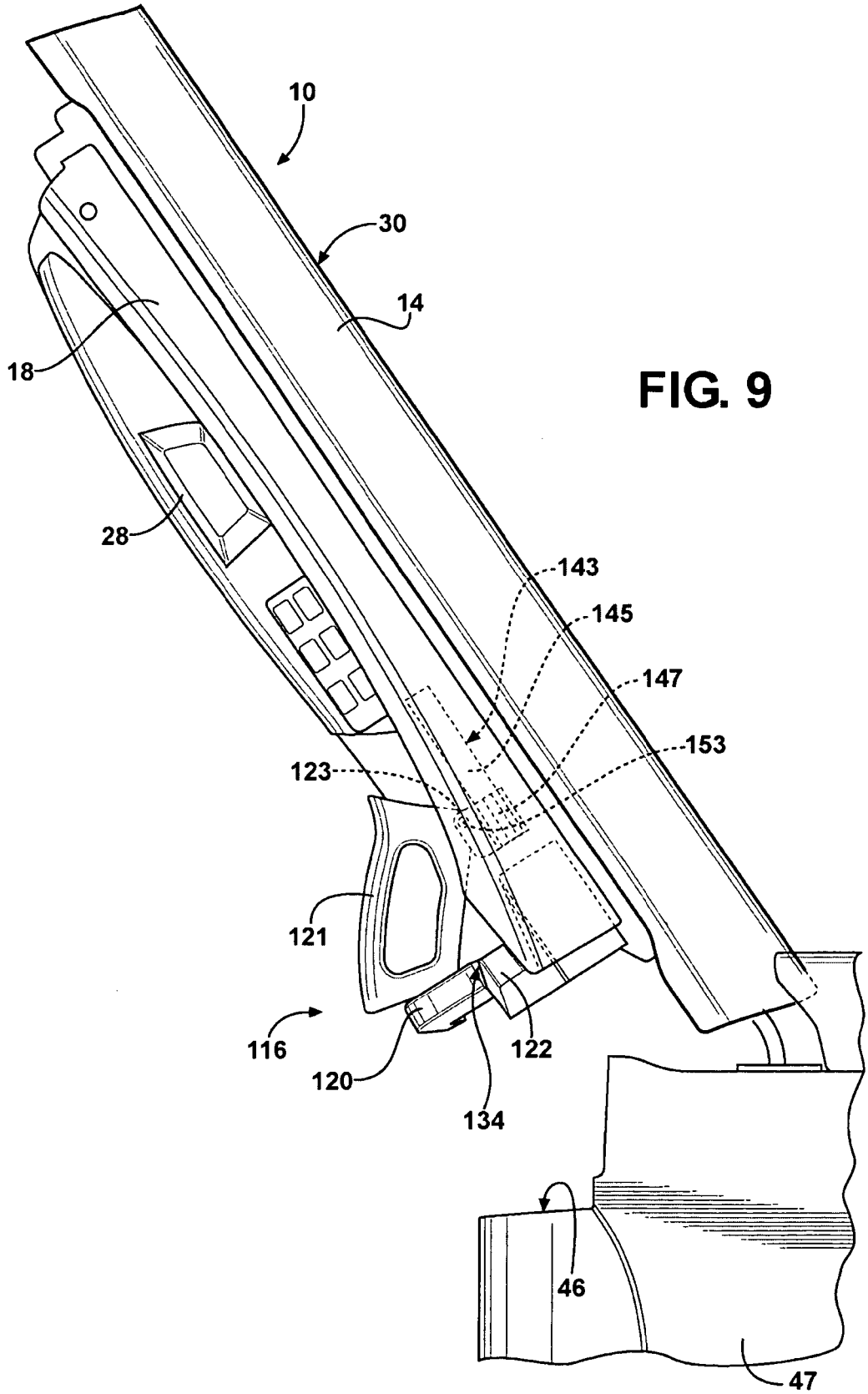
FIG. 9 is a partial schematic top view of the interior of the door and the IP of FIG. 6 with the door in the open position and each of the primary assist handle and the secondary assist handle pivotally extended.
Figure 10:
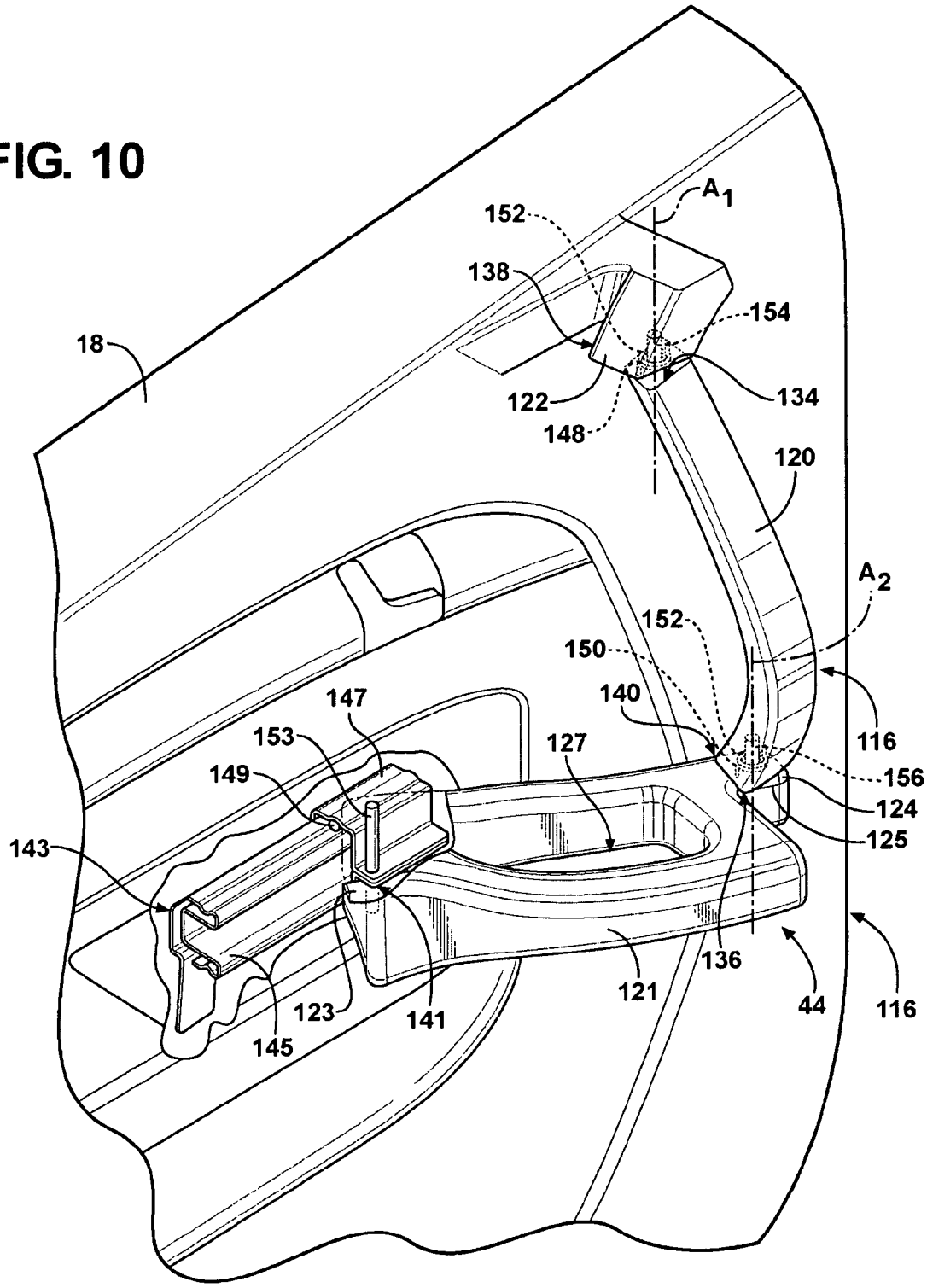
FIG. 10 is a partial schematic perspective view of the interior of the door of FIG. 6 with the door in the open position with the primary assist handle and the secondary handle pivotally extended.

Referring to FIGS. 7 and 10, a first extension 122 is configured to extend from a door panel 18. A second extension 124 extends from the second mounting portion 125 of the secondary assist handle 121, in spaced relationship to the first extension 122. The primary assist handle 120 extends between a first end 134 and a second end 136 and is disposed in generally perpendicular relationship to the second assist handle 121. This means that the primary assist handle 120 may be disposed generally perpendicular to the ground while the secondary assist handle 121 may be disposed in generally parallel relationship to the ground.

Referring to FIGS. 7 and 10, the first extension 122 pivotally supports the first end 134 of the primary assist handle 120 at a first pivot 138 and the second extension 124 pivotally supports the second end 136 of the primary assist handle 120 at a second pivot 140. The first pivot 138 rotates about a first axis A1 and the second pivot 140 rotates about a second axis A2 that is in a spaced relationship to the first axis A1. Therefore, in this embodiment, the first axis A1 and the second axis A2 are not coaxial. The primary assist handle 120 pivots about the first and second pivot 138, 140, relative to the respective extensions, between a retracted position 42 and an extended position 44, as described previously. The user may grasp the primary assist handle 120 when the primary assist handle 120 is in the extended position.

Referring to FIG. 10, the first mounting portion 123 of the secondary assist handle 121 is configured to pivotally extend from the door panel 18 at a third pivot 141. A rail assembly 143 is configured to extend from the door panel to slidably support the first mounting portion 123 of the secondary assist handle 121. Therefore, the secondary assist handle 121 is slidably and pivotally supported by rail assembly 143.

Referring again to FIG. 10, the rail assembly 143 includes a rail 145 configured to extend from the door panel 18. A guide 147 is in sliding engagement with the rail 145. The first mounting portion 123 pivotally extends from the guide 147 at the third pivot 141 such that the first mounting portion 123 and the third pivot 141 of the secondary assist handle 121 move linearly along the rail 145 in response to the guide 147 moving linearly along the rail 145. As the secondary assist handle 121 moves linearly along the rail 145, the secondary assist handle 121 rotates relative to the rail assembly 143 at the third pivot 141. As the secondary assist handle 121 rotates about the third pivot 141 and the guide 147 moves along the rail 145, the second mounting portion 125, the second extension 124, the second pivot 140 and the second axis A2 rotate about the first extension 122, the first pivot 138, and the first axis A1 in an arc.

To facilitate smooth sliding of the guide 147 along the rail 145, at least one ball bearing 149 may be disposed between the rail 145 and the guide 147 for facilitating movement of the guide 147 along the rail 145.

Referring again to FIG. 10, the first pivot 138 includes a first pin 154 that rotatably interconnects the primary assist handle 120 and the first extension 122. The second pivot 140 includes a second pin 156 that rotatably interconnects the primary assist handle 120 and the second extension 124 to facilitate rotation of the primary assist handle 120 about each of the first and second pivots 138, 140, relative to each of the extensions 122, 124. The first pivot 138 may include a first biasing device 148 that reacts between the first end of the primary assist handle 120 and the first extension 122. The second pivot 140 may include a second biasing device 150 that reacts between the second end of the primary assist handle 120 and the second extension 124. The first biasing device 148 and the second biasing device 150 are each configured to return the primary assist handle 120 from the retracted position 42 to the extended position 44 when the door assembly is in the open position. At least one of the biasing devices may be a spring 152, such as a torsion spring 152. It should be appreciated, however, that the biasing device is not limited to being a spring 152 as any other biasing device known to those skilled in the art may also be used. Likewise, a third pin 153 may rotatably interconnect the secondary assist handle 121 and the rail assembly 143 to facilitate rotation of the secondary assist handle 121 about the third pivot 141.

While the best modes for carrying out the invention have been described in detail, those familiar with the art to which this invention relates will recognize various alternative designs and embodiments for practicing the invention within the scope of the appended claims.

The invention claimed is:

1. A door assist assembly for being grasped by a user of a vehicle, said door assist assembly comprising:

an inner door panel;

a primary assist handle having a first end and a second end and configured for being grasped by a user of the vehicle;

a first extension extending from said door panel; and a second extension extending from said door panel in spaced relationship to said first extension;

wherein said first extension pivotally supports said first end of said primary assist handle at a first pivot and said second extension pivotally supports said second end of said primary assist handle at a second pivot such that said primary assist handle pivots about said first pivot and said second pivot, relative to each of said extensions between a retracted position and an extended position; and wherein said primary assist handle pivots about an axis and said axis extends in a generally vertical direction.

2. A door assist assembly, as set forth in claim 1, wherein said first pivot includes a first biasing device reacting between said first end and said first extension and configured for returning said primary assist handle from said retracted position to said extended position.

3. A door assist assembly, as set forth in claim 2, wherein said second pivot includes a second biasing device reacting between said second end and said second extension and configured for cooperating with said first biasing device to return said primary assist handle from said retracted position to said extended position.

4. A door assist assembly, as set forth in claim 3, wherein at least one of said first biasing device and said second biasing device is a torsion spring.

5. A door assist assembly, as set forth in claim 1, wherein said first pivot includes a first pin rotatably interconnecting said primary assist handle and said first extension to facilitate rotation of said primary assist handle about said first pivot, relative to said first extension.

6. A door assist assembly, as set forth in claim 5, wherein said second pivot includes a second pin rotatably interconnecting said primary assist handle and said second extension to facilitate rotation of said primary assist handle about said second pivot, relative to said second extension.

7. A door assist assembly, as set forth in claim 1, wherein said door panel is a trim panel.

8. A door assist assembly, as set forth in claim 1, wherein said door panel and at least one of said first extension and said second extension are a single piece.

9. A door assist assembly for a vehicle comprising:

a primary assist handle having a first end and a second end and configured for being grasped by the user of the vehicle;

a secondary assist handle having a first mounting portion and a second mounting portion and configured for being grasped by the user of the vehicle;

a first extension configured to extend from a door panel; and a second extension extending from said second mounting portion of said secondary assist handle, in spaced relationship to said first extension;

wherein said primary assist handle is disposed in generally perpendicular relationship to said secondary assist handle;

wherein said first extension pivotally supports said first end of said primary assist handle at a first pivot and said second extension pivotally supports said second end of said primary assist handle at a second pivot such that said primary assist handle pivots about said first pivot and said second pivot, relative to each of said extensions and the door panel of the vehicle between a retracted position and an extended position;

wherein said first mounting portion is configured to pivotally extend from the door panel at a third pivot.

10. A door assist assembly, as set forth in claim 9, wherein said first pivot includes a first pin rotatably interconnecting said primary assist handle and said first extension and said second pivot includes a second pin rotatably interconnecting said primary assist handle and said second extension to facilitate rotation of said primary assist handle about said first pivot and said second pivot, relative to said first extension and said second extension, respectively.

11. A door assist assembly, as set forth in claim 9, wherein said first pivot includes a first biasing device reacting between said first end and said first extension, and wherein said second pivot includes a second biasing device reacting between said second end and said second extension and, wherein said first biasing device and said second biasing device are each configured for returning said primary assist handle from said retracted position to said extended position.

12. A door assist assembly, as set forth in claim 9, further comprising a rail assembly configured to extend from the door panel and, wherein said first mounting portion is further defined as pivotally extending from said rail assembly at a third pivot.

13. A door assist assembly, as set forth in claim 12, wherein said rail assembly includes a rail configured to extend from the door panel and a guide in sliding engagement with said rail and, wherein said first mounting portion pivotally extends from said guide at said third pivot such that said first mounting portion of said secondary assist handle moves linearly along said rail in response to said guide moving linearly along said rail and said secondary assist handle rotates relative to said rail assembly at said third pivot.

14. A door assist assembly, as set forth in claim 13, wherein said rail assembly further includes at least one ball bearing disposed between said rail and said guide for facilitating movement of said guide along said rail.

15. A door assist assembly, as set forth in claim 13, wherein said third pivot includes a third pin rotatably interconnecting said secondary assist handle and said rail assembly.

16. A door assist assembly, as set forth in claim 9, wherein said secondary assist handle defines an opening configured for receiving fingers of the user when grasping the secondary assist handle.

17. A door assembly for a vehicle having an instrument panel and movable between an open position, away from the instrument panel, and a closed position, toward the instrument panel, said door assembly comprising:

a door panel;

a primary assist handle extending between a first end and a second end and configured for being grasped by the user of the vehicle;

a secondary assist handle extending between a first mounting portion and a second mounting portion and configured for being grasped by the user of the vehicle;

a first extension extending from said door panel; and a second extension extending from said second mounting portion of said secondary assist handle, in spaced relationship to said first extension;

wherein said primary assist handle is disposed in generally perpendicular relationship to said secondary assist handle;

wherein said first extension pivotally supports said first end of said primary assist handle at a first pivot and said second extension pivotally supports said second end of said primary assist handle at a second pivot such that said primary assist handle pivots about said first pivot and said second pivot, relative to each of said extensions from an extended position to a retracted position in response to contact between the primary assist handle and the instrument panel when said door assembly is in the closed position;

wherein said primary assist handle pivots about said first pivot and said second pivot, relative to each of said extensions from said retracted position to said extended position in response to said primary assist handle moving out of contact with the instrument panel when said door assembly is in the open position;

wherein said first mounting portion pivotally extends from said door panel at a third pivot.

18. A door assembly, as set forth in claim 17, further comprising:

a rail assembly configured to extend from said door panel and, wherein said first mounting portion is further defined as pivotally extending from said rail assembly at a third pivot, wherein said rail assembly includes a rail configured to extend from said door panel and a guide in sliding engagement with said rail and, wherein said first mounting portion pivotally extends from said guide at said third pivot such that said first mounting portion of said secondary assist handle moves linearly along said rail in response to said guide moving linearly along said rail and said secondary assist handle rotates relative to said rail assembly at said third pivot.

19. A door assembly, as set forth in claim 17, wherein said primary assist handle is configured to being positioned in a recess defined by the instrument panel when said door assembly is in the closed position.

* * * * *